United States Patent [19]

Bechtold

[11] 4,441,284

[45] Apr. 10, 1984

[54] DOUBLE DOME SKYLIGHT ASSEMBLY

[76] Inventor: Stephen K. Bechtold, 28 Soundview Ave., East Northport, N.Y. 11731

[21] Appl. No.: 387,214

[22] Filed: Jun. 10, 1982

[51] Int. Cl.[2] ..... E04B 7/18; E04D 13/03

[52] U.S. Cl. ..... 52/72; 52/200

[58] Field of Search ..... 52/22, 58, 200, 72

[56] References Cited

U.S. PATENT DOCUMENTS

| | | | |
|---|---|---|---|
| 2,875,710 | 3/1959 | Bechtold | 52/58 |
| 4,073,097 | 2/1978 | Jentoft | 52/22 |
| 4,296,578 | 10/1981 | Keckman | 52/200 |

FOREIGN PATENT DOCUMENTS

| | | | |
|---|---|---|---|
| 2923765 | 12/1979 | Fed. Rep. of Germany | 52/200 |

*Primary Examiner*—John C. Murtagh

*Attorney, Agent, or Firm*—Scully, Scott, Murphy & Presser

[57] ABSTRACT

A skylight assembly is provided that is adapted to be mounted to cover an opening in a roof structure. The assembly includes a liner adapted to be mounted adjacent the edge of the opening in the roof structure around the periphery to surround the opening and to form a wall extending upward from the roof structure. Flashing is mounted at the area of joinder between the liner and the roof structure. An outer dome and an inner dome are spaced from one another with the outer dome overlying the inner dome. Both of the domes engage a sealing gasket positioned on the upper end of the liner wall. A supporting frame is coupled to the dome and the sealing gasket arrangement and is hinged to the liner to permit shifting thereof with respect to the liner between a closed position overlying the opening in the roof structure and an open position permitting access to the opening from the exterior of the roof structure. The domes are spaced from one another essentially a uniform distance over substantially their entire adjacent surfaces overlying the opening in the roof structure.

8 Claims, 3 Drawing Figures

DOUBLE DOME SKYLIGHT ASSEMBLY

BACKGROUND OF THE INVENTION

Skylight technology has advanced rapidly in recent years. As a result, there are a variety of different types of skylights that have been adapted to many environments, for example, roof structures of buildings and vehicles. Certain designs are permanently sealed and others are designed to be opened and closed as desired for ventilation purposes.

The types that open and close and of course more sophisticated and many designs have been developed to enhance the ease of opening and closing of the skylight while maintaining a weather proof and leak proof structure and being low cost in manufacture and dependable and easy to use over a prolonged period of time. The structures are normally designed to be permanently mounted in a roof structure. They must be versatile and easy to install in a finished roof whether it be as part of initial construction or in an existing roof. Cost is virtually always a factor that is given careful consideration.

Recent successful skylight designs of the type under consideration are disclosed in prior U.S. Pat. Nos. 2,875,710, and 3,093,613 and pending application Ser. No. 172,381 filed on July 25, 1980. A consideration of these three disclosures show the manner in which skylight designs have progressed over the past 20 years. The present invention represents desirable modifications in the same type of structure.

SUMMARY OF THE INVENTION

Thus, with the above background in mind, it is among the primary objectives of the present invention to provide an improved skylight assembly for a roof. In particular, the skylight assembly is formed with a double dome window portion shiftable between a position overlying an opening in the roof and a position permitting access to the opening in the roof from the exterior of the structure. The domes are spaced apart a uniform distance over substantially their entire adjacent surfaces overlying the opening in the roof structure. The domes are clear and transparent so that the light can pass therethrough into the interior of the structure.

It is an objective to form a maximum degree of dome separation, particularly at the edges to create a more uniform insulating condition. It is believed that a three quarter inch optimal separation should be maintained between the domes throughout the spaced adjacent dome surfaces.

This avoids any potential "cobweb" forming between the domes. "Cobweb" is caused by condensation at the edges of the domes when they are spaced too closely together. Also, a narrow space at the edges in comparison to the center of the dome arrangement restricts air circulation to the center where conduction due to air movement may occur.

Additionally, spacing the domes a greater distance at their outside edges provides for maximum covering of the rubber extrusion or gasket used in sealing the peripheral edges of the skylight. The outer dome extends over the upper and outer sides of the gasket and the inner dome extends into overlying relationship with respect to the inner side of the gasket. In this manner the domes cover the exposed surface of the gasket, usually formed of rubber material, and condensation is minimized due to the shielding of the coldest part of the assembly. For example, black rubber contains carbon black and is a good conductor of heat. In any case, the dome structure of the present invention acts as a protective covering for exposed portions of the gasket thereby providing an additional safeguard against undesirable heat transfer conditions and condensation.

Thus, it is an objective of the present invention to provide essentially uniform spacing between the domes over the substantial portion of their adjacent surfaces including out from the center to the peripheral edge portions of the domes and, particularly, those portions overlying the opening in the roof structure.

The skylight assembly is designed to take advantage of the attractive features of skylights in the above discussed prior disclosures and enhance them by incorporating uniformly spaced double domes. The skylight is formed of low cost materials, requires low maintenance, and is inexpensive to install. It is easy and efficient to operate between closed and open positions.

The uniform spacing between domes is achieved by forming molded outer and inner domes with conforming configurations in those adjacent portions overlying the opening in the roof structure and bounded by a sealing gasket. The uniform spacing projects to and includes the location of the sealing gasket thus avoiding any danger of "cobweb" at the corners.

In summary, a skylight assembly is provided that is adapted to be mounted to cover an opening in a roof structure. The assembly includes a liner adapted to be mounted adjacent the edge of the opening in the roof structure around the periphery to surround the opening and to form a wall extending upward from the roof structure. An outer dome and an inner dome are spaced from one another with the outer dome overlying the inner dome. Both of the domes engage sealing means positioned on the liner wall. A supporting frame is coupled to the dome and sealing means arrangement and the frame and arrangement is hinged to the liner to permit shifting thereof with respect to the liner between a closed position overlying the opening in the roof structure and an open position permitting access to the opening from the exterior of the roof structure. The domes are spaced from one another essentially a uniform distance over substantially the entire adjacent surfaces overlying the opening in the roof structure.

With the above objectives among others in mind, reference is made to the attached drawings.

DETAILED DESCRIPTION

Figure 1:
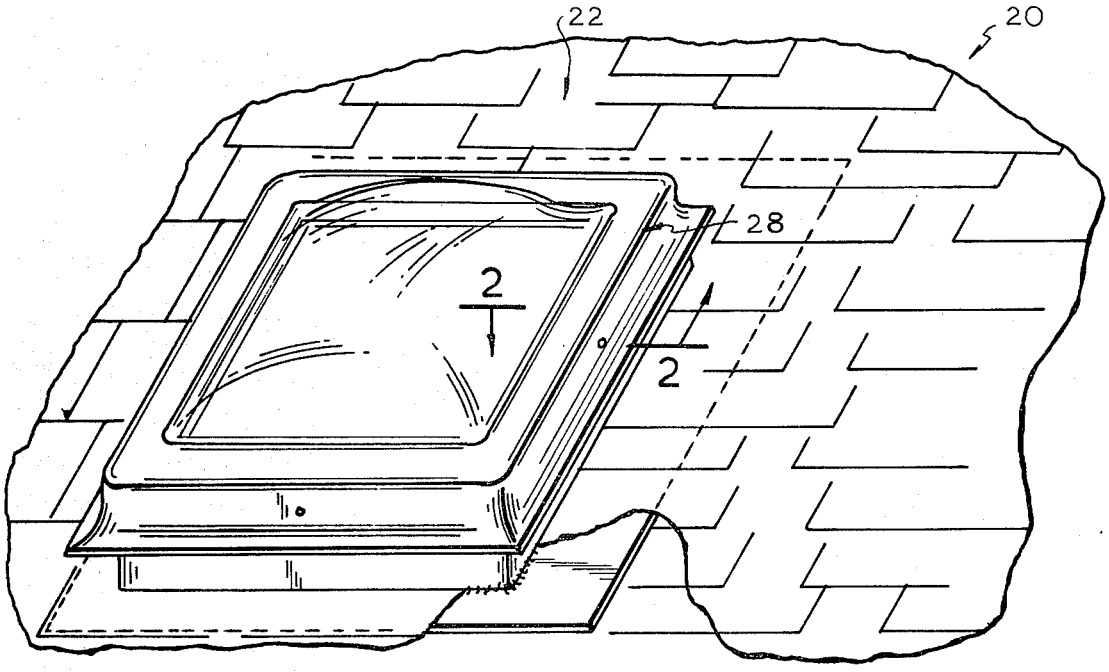
FIG. 1 is a plan view of a skylight assembly of the invention mounted on a roof.
Figure 2:
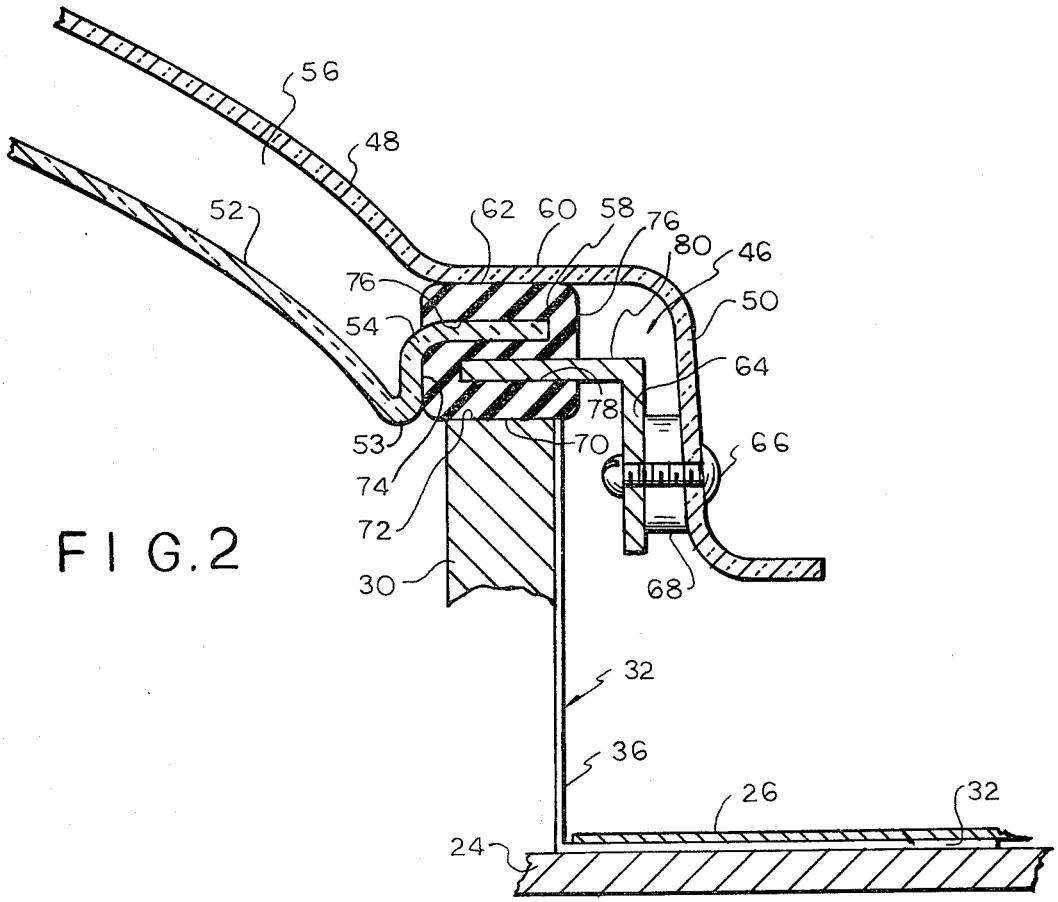
FIG. 2 is an enlarged fragmentary sectional view of the skylight assembly taken along the plane of line 2—2 of FIG. 1.
Figure 3:
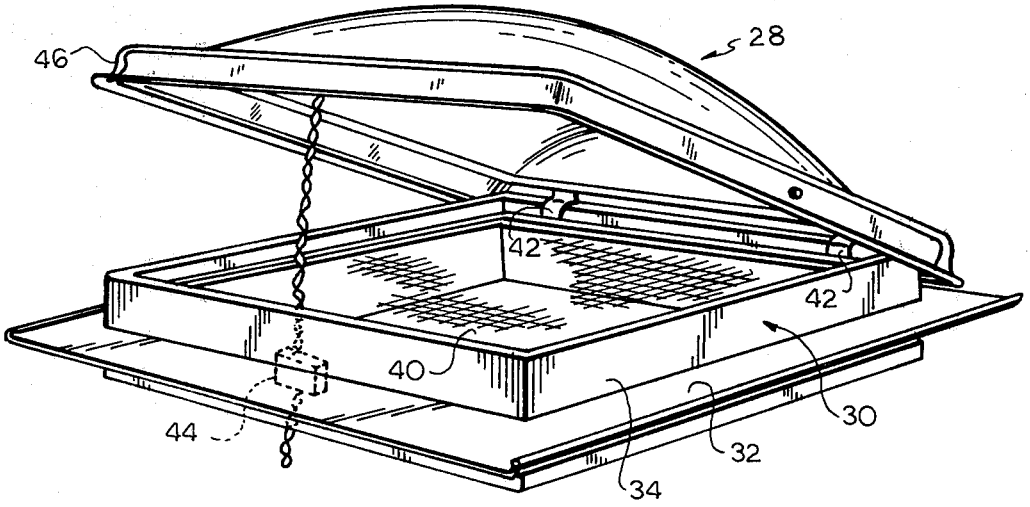
FIG. 3 is a perspective view of the skylight assembly mounted on a roof and in the open position.

Roof 20 is shown with skylight assembly 22 of the present invention mounted thereon. Roof 20 includes conventional roof sheathing 24 covered by an overlay of conventional shingles 26.

Skylight 22 includes a swinging window unit 28, box-like frame or liner 30, and a flashing frame 32.

Box-like frame 30 includes four adjoining side walls 34 arranged in a rectangular or square configuration to form an aperture therebetween. The walls 34 can be formed of conventional material such as wood, for example plywood, or metal.

The sheet of flashing 32 is mounted on the roof surface in a conventional manner between the sheathing 24 and the shingles 26 and walls 34 by extending up the walls and over the upper edge and is affixed in a conventional manner in that position. The flashing is arranged to surround an opening 38 in the roof and the frame or liner 34 also surrounds the periphery of opening 38 in the roof so that the aperture 40 in the frame is aligned with the opening 38 in the roof structure. A suitable screen can be conventionally mounted on the interior of the walls 34 to overlie opening 38 in the roof structure and extend across aperture 40 in the frame 30.

The swing away window unit 28 is mounted on one of the walls 34 of the liner 30 by the use of suitable hinges 42. The side of the window unit 28 opposite the side connected by hinges 42 is provided with a suitable operating unit 44 for opening and closing of the window unit 28 with respect to the liner 30 as it rotates about hinges 42. The operating unit 44 can be a well known type of handle, pole or motorized unit.

Window unit 28 includes a peripheral supporting frame 46 conforming to the configuration of walls 34 of liner 30 and being slightly larger so that the frame 46 can be lowered to a surrounding side by side relationship with the walls 34 when the skylight 22 is closed. Supported by the frame is an outer dome-shaped or exteriorally convex like-transparent window 48. In this connection, window 48 may be formed from a suitable resinous material commercially employed for such purposes. Outer dome or window 48 preferably terminates along its periphery in a depending integral skirt 50. The frame 46 can be formed of a conventional well known material, for example, aluminum or stainless steel. Outer dome 48 can be formed, for example, of clear acrylic plexiglass.

Window 48 forms an outer dome which is spaced from an inner insulating dome 52 of similar material which is preferably clear or white translucent. The peripheral edge portion 54 of inner dome 52 is sealed as is the peripheral end portion 50 of outer dome 48. Insulation is facilitated by the insulating space 56 between the inner and outer domes. Adjacent to the peripheral edge portion 54 of the inner dome is an arcuately shaped portion 53 which serves to interconnect the central portion of the dome 52 with the peripheral edge portion 54 and maintain the essentially uniform spacing for the insulating space 56 over substantially the entire adjacent surface area of the domes 52 and 48.

An extrusion or gasket 58 of conventional sealing material such as rubber is used to seal the peripheral edges of the double dome structure. Outer dome 48 has an intermediate end portion 60 resting on the upper surface 62 of extrusion 58 and it is anchored to the L-shaped supporting frame 46 by attachment of skirt 50 to leg 64 of frame by a suitable plurality of spaced nut and bolt assemblies 66. A suitable grommet 68 reinforces each assembly 66 in the space between leg 64 of frame 46 and the inner surface of skirt 50 of outer dome 48.

Extrusion or gasket 58 has its undersurface 70 seated on the upper edge 72 of the walls 34 of frame 30. Extrusion 58 also rests on the exposed upper surface of hinges 42 mounted to liner 30 as the gasket extends around the periphery of the skylight assembly 22.

The inner side 74 of gasket 58 includes an elongated longitudinal slot 76 to receive the peripheral edge portion 54 of the inner dome 52 therein in sealing interengagement. The outer side 76 of the gasket 58 includes a similar elongated longitudinal recess or slot 78 positioned below slot 76 and having a portion of leg 80 of frame 46 mounted therein in sealing interengagement therewith.

Substantially all of the exposed surfaces of gasket 58 are covered. Its upper surface 62 is covered by intermediate end portions 60 of outer dome 48. The outer surface 76 of the gasket 58 is covered by the peripheral end portion 50 of outer dome 48 and supporting frame 46. The undersurface 70 of gasket 58 is covered by the upper edge 72 of the walls 34 of frame 30. The inner side 74 of gasket 58 is covered by inner dome 52, particularly the arcuate portion 53 adjacent to the peripheral edge 54 sealed within recess 76 of the gasket. In fact the portion of dome 52 interconnecting arcuate portion 53 and peripheral edge 54 is preferably touching, as shown, or immediately adjacent to and parallel with inner side 74 of gasket 58. Thus, with the gasket surfaces covered, particularly with the inner dome 52 covering the inner surface 74 of the gasket, condensation is minimized. The coldest part of the assembly is shielded. This is particularly advantageous when the material of gasket 52 is a conventional black rubber which contains carbon black and is a good conductor of heat. Condensation and heat transfer problems are minimized. Thus, the arcuate portion 53 serves two purposes, it covers and protects an exposed surface on the gasket 58 and also aids in maintaining a uniform optimum spacing between the domes over the adjacent surfaces.

Both outer dome 48 and inner dome 52 are molded and have conforming configurations for the portions thereof which overlie aperture 40 in assembly 22 and opening 38 in the roof structure. These portions of dome 48 and 52 are essentially uniformly spaced over substantially their entire areas so as to form a constant width space 56 therebetween. For example, in actual use, an appropriate three quarter inch optimal separation has been found to be effective when maintained throughout the dome surface. The increased dome separation at the edges adjacent to gasket 58 provides a uniform insulation condition. Thus, there is no danger of "cobweb" looking condensation at the corners of the skylight assembly 22 and air circulation in the center of the double dome structure where conduction due to air movement could occur is prevented.

In use, the roof structure 20 is prepared in a conventional manner by forming an opening 38 in the upper surface and preparing the sheathing 24 and shingles 26 for receipt of the unit 22.

Flashing sheet 32 is mounted to the roof and surrounds opening 38 and the aperture 40 in liner 30 is aligned with opening 38 in the roof. This also causes alignment between the domes of the window unit 28 and the opening in the roof. The window portion 28 can be opened and closed as desired by using operator 44. The screen 40 will protect the opening 38 in the roof when the window unit 28 is shifted to the open position.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A skylight assembly adapted to be mounted to cover an opening in a roof structure comprising; a linear adapted to be mounted adjacent the edge of the opening in the roof structure around the periphery to surround the opening and to form a wall extending upward from the roof structure, an outer dome and an inner dome spaced from one another and with the outer dome overlying the inner dome, both of said domes engaging sealing means positioned on the liner wall, a supporting frame coupled to said dome and sealing means arrangement and the frame and arrangement being hinged to said liner to permit shifting thereof with respect to the liner between a closed position overlying the opening in the roof structure and an open position permitting access to the opening from the exterior of the roof structure, the domes being spaced from one another essentially a uniform distance over substantially their entire adjacent surfaces overlying the opening in the roof structure, the sealing means being a gasket positioned around the upper end peripheral surface of the wall of the liner, the inner side of the gasket having a slot therein adapted to receive and seal the peripheral edge of the inner dome, the outer side of the gasket having a slot therein to sealingly engage the frame attached to the outer dome, and a portion of the outer dome inwardly spaced from its outer peripheral edge resting on the upper surface of the gasket.

2. The invention in accordance with claim 1 wherein flashing means is mounted in the area of joinder between the liner and the roof structure.

3. The invention in accordance with claim 1 wherein the inner and outer domes are transparent and are molded with conforming configurations over the portions thereof adjacent to one another and overlying the opening in the roof structure.

4. The invention in accordance with claim 1 wherein the spacing of the domes is approximately $\frac{3}{4}$ of an inch.

5. The invention in accordance with claim 1 wherein the assembly is rectangular in configuration.

6. The invention in accordance with claim 1 wherein shielding means is provided to substantially cover all of the exposed surfaces of the sealing means and minimize the possibility of condensation forming thereabout.

7. The invention in accordance with claim 6 wherein the shielding means includes an arcuate portion on the inner dome extending into overlying relationship with the inner surface of the sealing means.

8. The invention in accordance with claim 7 wherein the arcuate portion of the inner dome is positioned adjacent the peripheral edge of the inner dome and operates in maintaining the uniform spacing between the domes.

* * * * *